US009579911B2

(12) United States Patent
De Bellis et al.

(10) Patent No.: US 9,579,911 B2
(45) **Date of Patent: *Feb. 28, 2017**

(54) PRINT MEDIUM ADVANCING DISTANCE ADJUSTMENT

(71) Applicant: Hewlett-Packard Development Company, L.P., Houston, TX (US)

(72) Inventors: David E. De Bellis, Vancouver, WA (US); Teresa Gene Trueba Embree, Vancouver, WA (US); Hsue-Yang Liu, Vancouver, WA (US); Elizabeth Ezetta, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/918,369

(22) Filed: Oct. 20, 2015

(65) Prior Publication Data

US 2016/0039232 A1 Feb. 11, 2016

Related U.S. Application Data

(63) Continuation of application No. 14/241,788, filed as application No. PCT/US2011/052863 on Sep. 23, 2011, now Pat. No. 9,193,158.

(51) Int. Cl.

| | |
|---|---|
| ***B41J 25/00*** | (2006.01) |
| ***B41J 19/96*** | (2006.01) |
| ***B41J 2/07*** | (2006.01) |
| ***B41J 11/00*** | (2006.01) |

(Continued)

(52) U.S. Cl.

CPC ..... *B41J 25/001* (2013.01); *B41J 2/07* (2013.01); *B41J 11/008* (2013.01); *B41J 11/42* (2013.01); *B41J 19/96* (2013.01); *B41J 29/38* (2013.01)

(58) Field of Classification Search

CPC ... B41J 2/07; B41J 11/008; B41J 11/42; B41J 19/96; B41J 25/001; B41J 29/38

See application file for complete search history.

(56) References Cited

U.S. PATENT DOCUMENTS

| | | | |
|---|---|---|---|
| 4,565,461 | A | 1/1986 | Usui et al. |
| 5,238,315 | A | 8/1993 | Kitabata |

(Continued)

FOREIGN PATENT DOCUMENTS

| | | |
|---|---|---|
| CN | 1798655 | 7/2006 |
| CN | 201745255 | 2/2011 |

(Continued)

OTHER PUBLICATIONS

European Patent Office. Supplementary Search Report. Issue date Mar. 31, 2015. Application No. 11872592.8.

(Continued)

*Primary Examiner* — Justin Seo
*Assistant Examiner* — Roger W Pisha, II
(74) *Attorney, Agent, or Firm* — Mannava & Kang P.C.

(57) ABSTRACT

A sweep speed is determined for sweeping a printer head of a printer across a print medium for printing a swath of an image on the print medium. A distance by which to advance the print medium is at least partially determined in accordance with the determined sweep speed and the print medium is advanced by the determined distance.

15 Claims, 3 Drawing Sheets

(51) Int. Cl.
*B41J 11/42* (2006.01)
*B41J 29/38* (2006.01)

(56) References Cited

U.S. PATENT DOCUMENTS

| | | | | |
|---|---|---|---|---|
| 5,669,721 | A * | 9/1997 | Santon | B41J 19/202 400/279 |
| 6,848,765 | B1 * | 2/2005 | Cleveland | B41J 2/2132 347/104 |
| 7,815,285 | B2 | 10/2010 | Barkley et al. | |
| 7,845,751 | B2 | 12/2010 | Rueby | |
| 7,988,251 | B2 | 8/2011 | Dimitrijevic et al. | |
| 9,193,158 | B2 * | 11/2015 | De Bellis | B41J 19/96 |
| 2002/0063871 | A1 | 5/2002 | Kinas | |
| 2003/0048326 | A1 | 3/2003 | Yamasaki et al. | |
| 2003/0112282 | A1 * | 6/2003 | de Pena | B41J 2/2132 347/5 |
| 2007/0019061 | A1 | 1/2007 | Koyabu et al. | |

FOREIGN PATENT DOCUMENTS

| | | |
|---|---|---|
| JP | 2010215345 | 9/2010 |
| WO | WO-2010125129 | 11/2010 |

OTHER PUBLICATIONS

International Searching Authority, International Preliminary Report on Patentability, Mar. 25, 2014, 6 Pages.
International Searching Authority, the International Search Report and the Written Opinion, May 7, 2012, 9 Pages.

* cited by examiner

PRINT MEDIUM ADVANCING DISTANCE ADJUSTMENT

PRIORITY

This application is a continuation of commonly assigned U.S. patent application Ser. No. 14/241,788, filed Feb. 27, 2014, now U.S. Pat. No. 9,193,158, which is a national stage filing under 35 U.S.C. 371 of PCT application number PCT/US2011/052863, having an international filing date of Sep. 23, 2011, the disclosures of which are hereby incorporated by reference in their entireties.

BACKGROUND

In inkjet printing, a printing head may be scanned back and forth across a printing medium, such as a sheet of paper. As the printing head is scanned across the printing medium, the printing head may deposit ink on the medium. Deposition of the ink may be performed in accordance with a set of instructions. For example, the instructions may include programming, in addition to a file that describes an image or text to be printed on the medium. A single pass of the printing head over the medium may result in printing a single swath of the image on the medium.

Concurrently with scanning the printing head across the medium, the medium may be advanced in a direction that is perpendicular to the scanning direction. The advancing of the medium may enable the image to be printed on the medium as a series of adjacent printed swaths. For example, between passes of the printing head over the medium, the medium may be advanced by a distance that is approximately equal to the width of the swath.

The combined coordinated motions of the printing head and the medium may enable an image to cover a wider area of the medium than would be possible if only the printing head or the medium were moved.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

DETAILED DESCRIPTION

Figure 1:
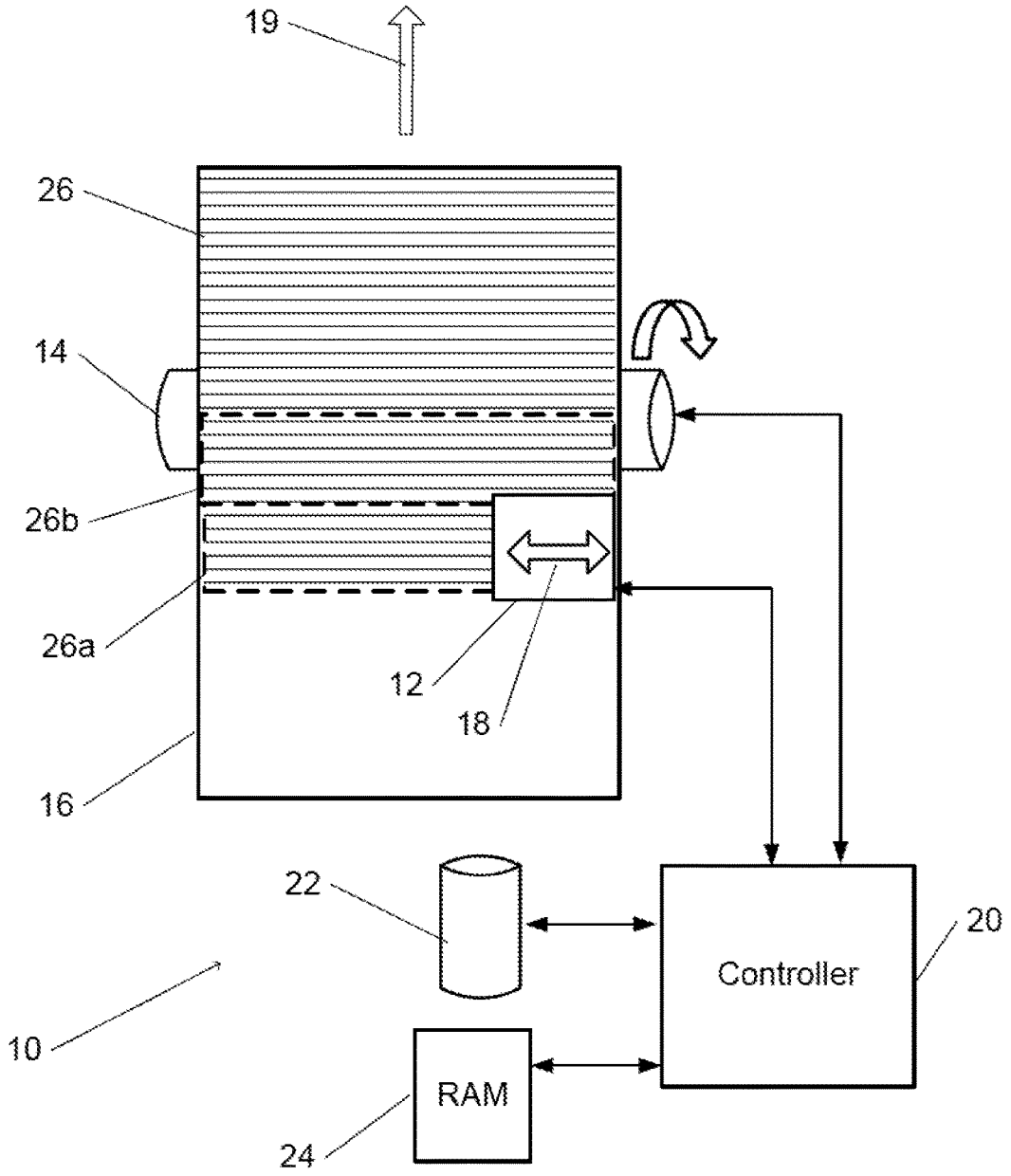
FIG. 1 illustrates a schematic of a printer system for implementation of print medium advancing adjustment in accordance with an embodiment of the invention.

In accordance with an embodiment of the invention, a printer includes a moveable printer head and a mechanism for advancing a print medium, such as, for example, a sheet of paper or similar material. Operation of the printer head and of the mechanism for advancing the print medium may be controlled, e.g. by a controller component or module that is associated with the printer. Coordinated operation of the printer head and the print medium may enable the printer to print an image on the print medium. As used herein, an image may be understood to refer to any printed content.

Such printed content may include, for example, drawings, pictures, figures, diagrams, patterns, graphics, text, symbols, maps, backgrounds, or any combination of the above.

For example, the printer head may be controlled to scan or sweep across the print medium while depositing ink on a surface of the print medium in a controlled manner. For example, ink may be deposited in a pattern that is determined by an appropriate set of image data.

A single sweep of the printer head over the print medium surface may deposit ink in a single swath of the surface of the print medium. For example, during the time that the printer head is printing a swath, the print medium may be kept stationary such that the printed swath is substantially parallel to the direction of sweeping motion of the printer head. When the sweep of the printer head is complete, the mechanism for advancing the print medium may then be operated to move the print medium such that the next sweep of the printer head may enable depositing ink in a swath that is adjacent to the swath that was deposited by the previous sweep. The next sweep may include sweeping the printer head across the print medium in the opposite direction of the previous sweep, or in the same direction (after returning the printer head from one side to the other, or after a sweep that involves a back-and-forth motion in both directions).

The sweeping speed of the printing head may be determined in accordance with various considerations. For example, a rate of ink deposition (e.g. mass or volume per unit time) by a nozzle of the printer head may be limited. In some cases, printing a particular image may require depositing ink with a relatively large area density (amount, mass or volume, of ink per unit area) on the print medium surface. For example, large area densities of ink may be required when printing a solid black or colored background or when printing a darkly colored or shaded region. In such a case, deposition of ink with the required area density may require slowing the sweep speed of the printer head.

In accordance with an embodiment of the invention, a distance by which the print medium is advanced between sweeps may be adjusted in accordance with a sweep speed of the printer head. For example, the sweep speed that was used in printing a swath immediately prior to advancing the print medium, the sweep speed that is to be used in printing a swath immediately following advancing the print medium, or both, may be determined. For example, the sweep speed for printing either swath may be obtained from the controller or from a memory or data storage device that is associated with the controller.

In accordance with an embodiment of the invention, the determined sweep speeds may be compared with a predetermined range of sweep speeds. If the determined sweep speed is within the predetermined range, the print medium may be advanced by a nominal advancing distance. However, if one or both of the determined sweep speeds is outside of the predetermined range, the advancing distance may be adjusted to be greater than, or less than, the nominal advancing distance.

For example, if either, or both, of the sweep speeds is less than a predetermined threshold sweep speed, the advancing distance may be decreased from a nominal advancing distance. For example, a nominal advancing distance may be determined by one or more considerations such as a width of a printing area of the printer head, a nominal distribution of deposited ink by the printer head, or other considerations based on properties of ink deposition by the printing head.

When operating a printer, the print medium may be actually advanced by a distance that is different from an intended advancing distance as determined by a controller.

For example, variation in the actual advancing distance may result form variations in the print medium (e.g. paper width, weight, texture, thickness, stiffness) or in environmental factors (e.g. ambient temperature or humidity). If the print medium were to be advanced by a distance that is greater than the swath width (overfeeding), a line of unprinted print medium ("white swath boundary" or WSB) could remain between adjacent swaths. Such an unprinted line could be especially visible and objectionable to a viewer in an otherwise uniform black or dark region. On the other hand, if the print medium is advanced by a distance that is less then the swath width (underfeeding), adjacent swaths could overlap. In this case, depending on the color of the ink being deposited and on other factors related to ink deposition (e.g. size of ink drops, type of ink or medium, deposition rate, density of deposited drops), the region (band) of the overlap could appear darker than adjacent regions of the printed image ("dark swath boundary" or DSB). Such a dark band could be especially visible or objectionable to a viewer of the printed medium in the middle of an otherwise uniformly colored region.

Thus, although a problem of WSB could be avoided by deliberately underfeeding a print medium, unmodified application of the underfeeding could create a problem of DSB elsewhere. Other solutions that have been proposed or utilized for the purpose of reducing or eliminating WSB, DSB, or both, either for application in conjunction with underfeeding or separately, include improved calibration of the print medium advancing, and increasing or decreasing deposition of dark or black ink near swath boundaries, For example, a nominal advance distance may be selected such that there is a small amount of overlap between adjacent swaths (underfeed). For example, such underfeeding may be designed to avoid noticeable lines of unprinted print medium between the printed swaths ("white swath boundaries").

Measurement of swath width for various printer head sweep speeds may yield a repeatable relationship between swath width and printer head sweep speed. Thus, in accordance with an embodiment of the invention, control of a print medium advancing medium may be adjusted so as to match a print medium advancing distance to a swath width that corresponds to the sweep speed. For example, swath width may be found to be wider for faster sweep speeds than for slower sweep speeds. Thus, in this case, the print medium may be advanced by a smaller distance when one of the adjacent swaths was printed at a slower sweep speed and by a larger distance when one of the adjacent swaths was printed at a faster sweep speed.

FIG. 1 illustrates a schematic of a printer system for implementation of print medium advancing adjustment in accordance with an embodiment of the invention.

Printer system 10 includes a printer head 12 that may be moved back and forth, or swept (e.g. as indicated by arrow 18), across a print medium 16 (e.g. along a track or bar). For example, printer head 12 may be operated to sweeping across print medium 16 while depositing ink (or other printer fluid) on print medium 16. For example, ink may be deposited on print medium 16 to form a printed image 26. A single sweep of printer head 12 across print medium 16 (e.g. a single motion in one of the directions indicated by arrow 18, or a back-and-forth motion in the directions indicated by arrow 18). The ink may be deposited in the form of a single swath, such as currently printed swath 26*a* (shown as being currently printed by printer head 12) or previously printed swath 26*b*. For example, printer head 12 may include an array of nozzles for expelling ink in the direction of print medium 16 (e.g. an inkjet printer head).

Print medium advancing mechanism 14 may be operated so as to advance print medium 16 (e.g. in the direction indicated by arrow 19) in a controlled manner. For example, print medium advancing mechanism 14 may include one or more rollers, sprockets, belts, wheels, or one or more other mechanical, electrostatic, electromagnetic, or pneumatic devices. Operation of print medium advancing mechanism 14 may advance print medium 16 by a predetermined distance. For example, the predetermined distance may be selected so as to enable consecutive sweeps of printer head 12 to print in adjacent swaths (e.g. currently printed swath 26*a* and previously printed swath 26*b*) on print medium 16.

Operation of printer head 12 and of print medium advancing mechanism 14 may be operated by controller 20. For example, controller 20 may control with printer head 12, or with a mechanism associated with printer head 12 (e.g. an electric motor) so as to sweep printer head 12 across print medium 16. Controller 20 may also control operation of printer head 12 so as to cause printer head 12 to deposit ink on print medium 16 in a controlled manner (e.g. in accordance with image data). The sweeping speed of printer head 12 may be adjusted in accordance with content of image 26 and in accordance with capabilities (e.g. a printing rate for different types or densities of ink) of printer head 12. For example, a sweep that includes printing a swath with dark regions may be performed at a slower sweep speed than a sweep that does not.

Controller 20 may include one or more processors that may operate in accordance with programmed instructions. For example, controller 20 or a component of controller 20 may be incorporated into a printer, a component of a printer, or in a computer or processor that may communicate with the printer.

Controller 20 may communicate with a data storage device 22. For example, data storage device 22 may include one or more built-in or removable non-volatile data storage elements or devices. Controller 20 may communicate with a memory device, represented by random access memory (RAM) 24. For example, RAM 24 may include one or more volatile or non-volatile memory devices. Data storage device 22 and RAM 24 may be used to store data such as programmed instructions for operation of controller 20, data that define an image to be printed by printer system 10, or data or parameters related to operation of printer system 10. For example, data storage device 22 or RAM 24 may be used to store a sweep speed for printing a previously printed swath or a swath to be printed, and parameters related to a distance for advancing print medium 16 between swaths.

Controller 20 may control print medium advancing mechanism 14. For example, controller 20 may be programmed or configured to operate print medium advancing mechanism 14 to advance print medium 16 between sweeps by a nominal advancing distance under some conditions. For example, when the sweep speed of printer head 12 is within a predetermined range of sweep speeds, print medium 16 may be advanced by the nominal advancing distance. The nominal advancing distance may be determined in accordance with a nominal swath width. However, under other circumstances, controller 20 may be programmed or configured to operate print medium advancing mechanism 14 to advance print medium 16 by an advancing distance that is different from the nominal advancing distance. For example, if the sweep speed for a sweep that either preceded or is to follow the advancing of the print medium is slower than the predetermined range of sweep speeds, print medium 16 may be advanced by an advancing distance that is less than the nominal advancing distance.

Controller 20 may thus control print medium advancing mechanism 14 by applying a method in accordance with an embodiment of the invention.

Figure 2:
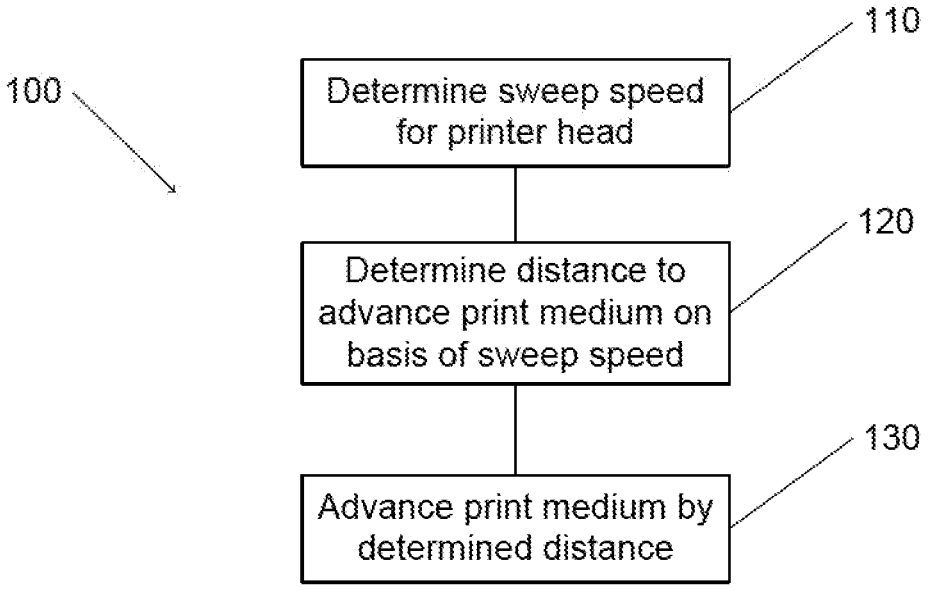
FIG. 2 is a flowchart of a method in accordance with an embodiment of the invention.

FIG. 2 is a flowchart of a method in accordance with an embodiment of the invention. It should be understood with respect to this flowchart, and with respect to other flowcharts referred to herein, that representation of the method by a particular division into operations indicated by discrete blocks is for convenience and clarity only. Other representations and division into operations are possible with equivalent results. Such alternative division into individual operations should be understood as falling within the scope of embodiments of the division. It should also be understood that, unless indicated otherwise, that the order of operations that are represented by blocks of the flowchart has been selected for convenience and clarity only. Performance of operations of the method in an alternative order, or concurrently, may yield equivalent results. Such reordering of operations of the method should be understood as falling within embodiments of the invention.

Print medium advancing control method 100 may be executed by a controller, or by a processor associated with a controller, that is configured to ascertain a sweep speed for a printer head, and that is configured to control an advancing distance for a print medium.

Print medium advancing control method 100 may be performed by the controller when, or prior to, controlling a print medium advancing mechanism to advance a print medium. The controller may determine a sweep speed for a sweep by a printer head that was previously made, for a sweep to be made after advancing the print medium, or both (block 110). For example, the controller that controls a print medium advancing mechanism may also be configured to control motion of the printer head, and thus also determine the sweep speed. As another example, a controller that controls a print medium advancing mechanism receive sweep speed data by communicating with a controller that is configured to control motion of the printer head. As another example, a controller that controls a print medium advancing mechanism may read a sweep speed from a memory device or data storage device to which a controller that is configured to control motion of the printer head writes sweep speed data.

A sweep speed may be selected in accordance with one or more considerations such as, for example, properties related to the content to be printed, the capabilities of the printing head, properties of the print medium, or ambient conditions.

A distance by which a print medium is to be advanced may then be determined based at least partially on the determined sweep speed (block 120). For example, a nominal advancing distance for the print medium may be based on a nominal width of a printed swath when the printer head is swept at a nominal sweep speed. The nominal advancing distance may, for example, be based on the nominal swath width, with a bias toward underfeeding in order to avoid WSB effects. When a sweep speed for one or both of two successive sweeps is different from the nominal sweep speed, an advancing distance being determined for advancing the print medium between the successive sweeps may be adjusted to be different from the nominal advancing distance.

For example, a width of a swath that is printed by the printer head as the printer head is swept across the print medium may be related (e.g. empirically) to the sweep speed of the printer head. As a more particular example, when the sweep speed is lower than a typical sweep speed, the width of the printed swath may be found to be narrower than is typical or nominal (e.g. a faster moving printer head may disperse ink over a wider area, e.g. due to aerodynamic effects, than a slower moving printer head). In such a case, the determined advancing distance may be reduced from the nominal advancing distance. For example, the reduction in advancing distance may be related to the difference in the anticipated swath widths.

The controller may then operate the print medium advancing mechanism to advance the print medium by the determined advancing distance (block 130). For example, a roller may be rotated through a determined distance so as to advance the print medium by a distance that is substantially equal to the determined advancing distance.

In this manner, WSB effects may be avoided between printed swaths, while DSB effects are similarly reduced or minimized.

In addition to adjusting the print medium advancing distance, other techniques may be applied so as to ensure absence of WSB effects. For example, additional ink may be applied to swath boundaries so as to further reduce the likelihood of WSB effects, e.g. due to variations in actually achieved advancing distance (e.g. within predetermined tolerance levels) due, e.g. to anticipated variations between print media, between print medium advancing mechanisms (e.g. differences between rollers or motors), in interactions between the two (e.g. difference is coefficients of friction), or between printer heads (e.g. weaker nozzles toward an end of the printer head). Application of additional ink may be limited to printing images in which WSB effects are expected to be more likely, or where WSB effects may be especially noticeable or disturbing.

In accordance with an embodiment of the invention, determining the distance by which to advance the print medium may include comparing a sweep speed with one or more predetermined threshold sweep speeds.

Figure 3:
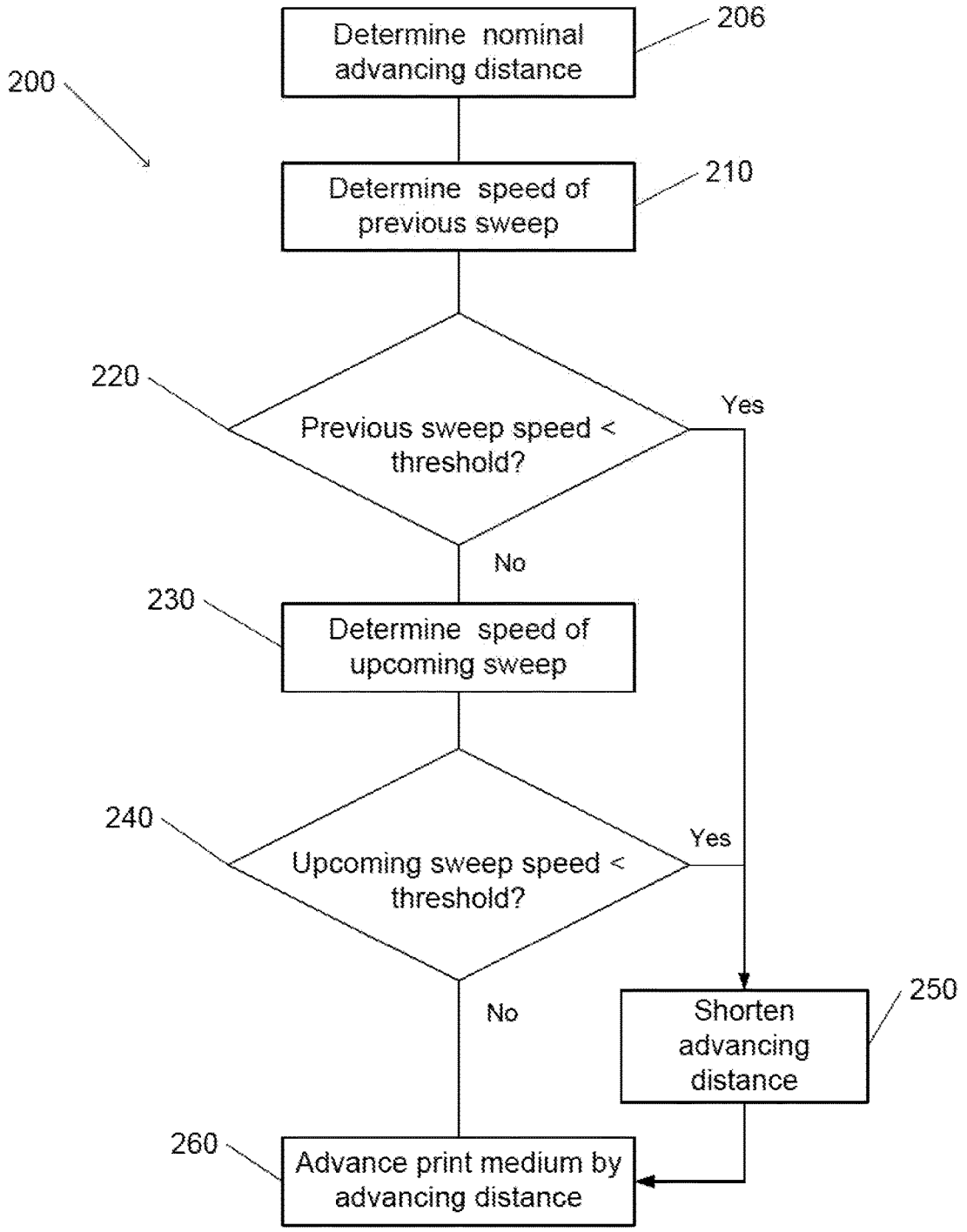
FIG. 3 is a flowchart of an example of the method illustrated in FIG. 2.

FIG. 3 is a flowchart of an example of the method illustrated in FIG. 2. Print medium advancing control method 200 may be performed by a controller of a printer system as part of controlling a print medium advancing mechanism to advance a print medium between two successive sweeps of a printer head.

Print medium advancing control method 200 includes determining a nominal advancing distance for advancing the print medium between the two successive sweeps (block 206). For example, the nominal advancing distance may be based on a nominal width of a swath that is printed by the printer head during one or both of the successive sweeps. The nominal advancing distance may include a bias toward underfeeding e.g. so as to minimize the possibility of WSB effects. In accordance with an embodiment of the invention, the advancing distance may depend in addition on a current position or status of the print medium. For example, a print medium advance mechanism may be configured to remove a print medium (e.g. a sheet of paper) from a stack of print media in a tray and move it toward the sweep path of the printer head. The advancing distance between two successive sweeps may vary, e.g., depending on whether or not the print medium is still partially resting in the tray, and on whether the print medium is being pushed or pulled by (e.g. by various rollers of) the print medium advancing mechanism.

A sweep speed of the previous sweep of the printer head to print a most recently printed swath may be determined (block 210). For example, the previous sweep speed may be stored on a memory device that is accessible by a controller that is executing print medium advancing control method 200. As another example, the previous sweep speed may be calculated on the basis of one or more of properties of a previously printed swath, of the print medium, or of the printer head.

For example, a printer head may have a sweep speed that may range from a nominal speed of about 100 centimeters per second (approximately equal to 40 inches per second) to a minimum value of about 50 centimeters per second (approximately equal to 20 inches per second).

The determined previous sweep speed may be compared with a threshold sweep speed (block 220).

If the determined previous sweep speed is less than the threshold sweep speed, an adjustment may be made to the previously determined nominal advancing distance for advancing the print medium prior to the upcoming sweep by the printer head (e.g. to print a swath that is adjacent to the previously printed swath—block 250). If the determined previous sweep speed is not less than the threshold sweep speed, no adjustment is made.

For example, relating to the above example, a threshold sweep speed may be approximately 64 centimeters per second (approximately equal to 25 inches per second). When the determined previous sweep speed is less than the threshold, the advancing distance (which itself may depend on a current status of the print medium) may be further shortened. For example, the advancing distance may be further shortened by about 0.33 millimeters (approximately equal to about 1.3 mil).

In another embodiment of the invention, the advancing distance may be varied as a continuously defined function of the determined previous sweep speed (instead of a single threshold and a single adjustment to sweep speed). For example, a lookup table that relates printer head sweep speed values to print medium advancing distance (or adjustments to an advancing distance) may be stored in a memory or data storage device that is accessible by a controller that is executing print medium advancing control method 200. As another example, a functional relationship may be defined for relating printer head sweep speed values to print medium advancing distance (or adjustments to an advancing distance). Thus, a print medium advancing distance may be calculated on the basis of the defined functional relationship.

If the determined previous sweep speed is not less than the threshold sweep speed, a sweep speed of the upcoming sweep of the printer head to print an upcoming swath (adjacent to the most recently printed swath) may be determined (block 230). For example, the upcoming sweep speed may be calculated on the basis of one or more of properties of the swath to be printed, of the print medium, or of the printer head.

The determined upcoming sweep speed may be compared with a threshold sweep speed (block 240). For example, the threshold sweep speed to which the upcoming sweep speed is compared may be identical to the threshold sweep speed to which the previous sweep speed was compared. As another example, the upcoming sweep speed and the previous sweep speed may be compared to different sweep speed thresholds (e.g. if ink dispersing properties of the printer head are not symmetrical).

If the determined upcoming sweep speed is slower than the threshold sweep speed, an adjustment may be made to the previously determined nominal advancing distance (block 250). For example, the adjustment made may be identical to the adjustment made when the determined previous sweep speed is slower than the threshold sweep speed. As another example, the adjustment that is made when the upcoming sweep speed is slow may be different from an adjustment made when the previous sweep speed is slow (e.g. if ink dispersing properties of the printer head are not symmetrical).

If the determined previous sweep speed is not less than the threshold sweep speed, no adjustment is made. In another embodiment of the invention, the advancing distance may be varied as a continuously defined function of the determined upcoming sweep speed. In this case, the advancing distance (or an adjustment to the advancing distance) may be determined, e.g. from a lookup table or from a defined function relationship that relates upcoming sweep speed with the advancing distance (or adjustment to the advancing distance).

The print medium advancing mechanism may be controlled by the controller to advance the print medium by the advancing distance (block 260). For example, if no adjustment was made, the print medium may be advanced by the nominal advancing distance. If the advancing distance was adjusted (e.g. shortened), the print medium may be advanced by the adjusted advancing distance.

Once the print medium is advanced, the printer head may be operated so as to perform the upcoming sweep, thus printing a swath that may be adjacent to the previously printed swath. Once the upcoming sweep is complete, print medium advancing control method 200 may be executed again and the print medium advanced by the resulting medium advancing distance. This procedure of printing a swath and executing print medium advancing control method 200 may be repeated until an entire image is printed on the print medium.

In another embodiment of the invention, the upcoming sweep speed may be determined (block 230) and compared to the sweep speed threshold (block 240) regardless of results of comparing the previous sweep speed with the sweep speed threshold (block 220). In this case, operations represented by block 230 and block 240 are always executed. For example, if both the previous sweep speed and the upcoming sweep speed are slower than the appropriate threshold sweep speeds, the medium advancing distance may be adjusted. In this case, the adjustment may be identical to an adjustment that would be made when only the previous sweep speed or the upcoming sweep speed is slower than the appropriate threshold sweep speed, or may be different (e.g. to compensate for width variation in both the previously printed swath and in the swath to be printed).

In another embodiment, the sweep speed may change during the course of a sweep. In this case, a sweep speed that is used as a basis for determining a print medium advancing distance may be a representative sweep speed (e.g. average, median, or other statistically representative sweep speed that may be related to the advancing distance).

In accordance with an embodiment of the invention, a computer program application stored in non-volatile memory or computer-readable medium (e.g., register memory, processor cache, RAM, ROM, hard drive, flash memory, CD ROM, magnetic media, etc.) may include code or executable instructions that when executed may instruct or cause a controller or processor to perform methods discussed herein, such as a method for adjusting a distance for advancing a print medium in accordance with an embodiment of the invention.

The computer-readable medium may be a non-transitory computer-readable media including all forms and types of memory and all computer-readable media except for a transitory, propagating signal. In one implementation, external memory may be the non-volatile memory or computer-readable medium.

We claim:

1. A printer comprising:

a printer head to sweep across a surface of a print medium to print on the print medium; and a controller to determine a sweep speed of sweeping the printer head across the print medium, and control an advancing mechanism to advance the print medium by a distance that is determined based on the determined sweep speed.

2. The printer of claim 1, wherein the print medium is advanced in a direction perpendicular to a direction of the sweeping of the printer head.

3. The printer of claim 1, wherein the advancing mechanism comprises a roller.

4. The printer of claim 1, wherein the controller is to determine the distance to advance the print medium.

5. The printer of claim 1, wherein the controller is to adjust the distance to a nominal distance in response to determining the sweep speed is outside a predetermined range of sweep speeds.

6. The printer of claim 1, wherein the controller is to determine the distance from a reduction of a nominal distance in response to determining the sweep speed is less than a predetermined threshold sweep speed.

7. A printer comprising:

a printer head to sweep across a surface of a print medium to print a swath on the print medium;

a controller to determine a sweep speed of sweeping the printer head across the print medium, wherein the sweep speed is: a sweep speed of the printer head that was used in printing a swath immediately prior to advancing the print medium; a sweep speed of the printer head that is to be used in printing a swath immediately following advancing the print medium; or both; and the controller is to control an advancing mechanism to advance the print medium by a distance that is determined based on the determined sweep speed.

8. The printer of claim 7, wherein the print medium is advanced in a direction perpendicular to a direction of the sweeping of the printer head.

9. The printer of claim 7, wherein the advancing mechanism comprises a roller.

10. The printer of claim 7, wherein the controller is to determine the distance to advance the print medium.

11. The printer of claim 7, wherein the controller is to adjust the distance to a nominal distance in response to determining the sweep speed is outside a predetermined range of sweep speeds.

12. The printer of claim 7, wherein the controller is to determine the distance from a reduction of a nominal distance in response to determining the sweep speed is less than a predetermined threshold sweep speed.

13. A controller for a printer, wherein the controller includes hardware, and the controller is to determine a sweep speed of sweeping a printer head across a print medium, and control an advancing mechanism to advance the print medium by a distance that is determined based on the determined sweep speed.

14. The controller of claim 13, wherein the sweep speed is: a sweep speed of the printer head that was used in printing a swath immediately prior to advancing the print medium; a sweep speed of the printer head that is to be used in printing a swath immediately following advancing the print medium; or both.

15. The controller of claim 13, wherein the controller is to adjust the distance to a nominal distance in response to determining the sweep speed is outside a predetermined range of sweep speeds; and the controller is to determine the distance from a reduction of a nominal distance in response to determining the sweep speed is less than a predetermined threshold sweep speed.

* * * * *